US006647958B2

(12) United States Patent
Yokoyama et al.

(10) Patent No.: US 6,647,958 B2
(45) Date of Patent: Nov. 18, 2003

(54) THROTTLE CONTROL APPARATUS FOR INTERNAL COMBUSTION ENGINE

(75) Inventors: Nobuaki Yokoyama, Tokyo (JP); Koji Nishimoto, Tokyo (JP); Shinji Watanabe, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 86 days.

(21) Appl. No.: 10/040,782

(22) Filed: Jan. 9, 2002

(65) Prior Publication Data

US 2003/0015173 A1 Jan. 23, 2003

(30) Foreign Application Priority Data

Jul. 13, 2001 (JP) ..... 2001-213352

(51) Int. Cl.[7] ..... F02D 41/00
(52) U.S. Cl. ..... 123/361; 123/339.14
(58) Field of Search ..... 123/350, 361, 123/399, 339.14; 73/118.2

(56) References Cited

U.S. PATENT DOCUMENTS 4,693,111 A 9/1987 Arnold et al.
5,568,386 A * 10/1996 Sugiura et al. ..... 701/51
5,746,178 A * 5/1998 Susaki et al. ..... 123/399
6,253,733 B1 * 7/2001 Marumoto et al. ..... 123/399

FOREIGN PATENT DOCUMENTS

JP 5-263703 10/1993
JP 10-222205 8/1998

* cited by examiner

*Primary Examiner*—Mahmoud Gimie
(74) *Attorney, Agent, or Firm*—Sughrue Mion, PLLC

(57) ABSTRACT

A throttle control apparatus for an internal combustion engine capable of controlling an opening degree of an electronic control type throttle with high accuracy by employing an inexpensive A/D converter. The apparatus includes a throttle opening degree detector, and a controller for controlling the opening degree to a target value in dependence on operation state of the engine. The throttle opening degree detector includes a throttle opening degree sensor, an offset unit for transforming the sensor voltage into a plurality of offset-weighted voltages (V1, . . . , V4), an A/D converter and an adder for adding the converted offset-weighted voltages (V1 to V4) wherein a sum value resulting from addition of the offset-weighted voltages (V1, . . . , V4) is detected as the opening degree of the throttle to be controlled.

7 Claims, 11 Drawing Sheets

FIG. 11

| GENERATED VOLTAGES WITH OFFSET | SW1 | SW2 | SW3 |
|---|---|---|---|
| V1 (P1) | OFF | OFF | OFF |
| V2 (P2) | ON | OFF | OFF |
| V3 (P3) | OFF | ON | OFF |
| V4 (P4) | OFF | OFF | ON |

THROTTLE CONTROL APPARATUS FOR INTERNAL COMBUSTION ENGINE

BACKGROUND OF THE INVENTION

1. Field of the Invention

The present invention generally relates to a control apparatus for an electronic control type throttle of an internal combustion engine for e.g. a motor vehicle. More particularly, the present invention is concerned with a throttle control apparatus for an internal combustion engine which apparatus can detect the opening degree of a throttle valve with an enhanced accuracy by using an inexpensive A/D converter of a relatively low resolution. At this juncture, with the phrase "electronic control type throttle", it is intended to mean a combination of a throttle valve disposed in an intake pipe of the internal combustion engine and an actuator therefor which is constituted by an electric motor.

2. Description of Related Art

In general, the throttle control apparatus of the internal combustion engine is designed to control the opening degree of the throttle valve so that it coincides with a desired or target opening degree which is arithmetically determined properly in dependence on the operation state of the motor vehicle. For further particulars, reference should be made to, for example, Japanese Patent Application Laid-Open Publication No. 222205/1998 (JP-A-10-222205).

The throttle control apparatus for the internal combustion engine includes a control means which is constituted by an ECU (Electronic Control Unit) for performing A/D conversion (analogue-to-digital conversion) of an output voltage of a throttle opening degree sensor for thereby arithmetically determining the target throttle opening degree on the basis of the value resulting from the A/D conversion. The electronic control type throttle is then so controlled that the opening degree thereof coincides with the determined target value through a feedback control.

In particular, in the idle operation mode of the engine, it is required to control the quantity of intake air flowing into the engine with a high accuracy in order to maintain a relatively low idle speed. To this end, the throttle control assuring a high reliability is demanded.

For realizing the high-accuracy control of the intake air flowing into the engine, the electronic control type throttle has to be controlled with a high accuracy, for which the capability of detecting the output voltage value of the throttle opening degree sensor with a high accuracy is prerequisite.

In this conjunction, a method of detecting accurately the sensor voltage indicative of the throttle opening degree (i.e., opening degree of the throttle valve) in an idle speed region of the engine is disclosed in Japanese Patent Application Laid-Open Publication No. 263703/1993 (JP-A-5-263703). According to this known method, two different throttle opening degree indicating voltages are detected, wherein the detected voltages for use are changed over between the idle speed region and the non-idle speed region.

However, the method disclosed in the publication cited just above suffers a problem that significant difference in level may undesirably make appearance between the detection values of the throttle opening degree upon changeover of the detection values although it depends on the accuracy of the changeover circuit as employed, which may exert adverse influence to the throttle control.

For coping with the problems mentioned above, it may be conceived to detect the throttle opening degree indicating voltage with a high accuracy by using the A/D converter exhibiting a high resolution, which is, however, very expensive, involving increased manufacturing cost of the control apparatus as a whole, giving rise to another problem.

As is apparent from the above, the conventional throttle control apparatus for the internal combustion engine, e.g. the apparatus disclosed in Japanese Patent Application Laid-Open Publication No. 263703/1993 suffers a problem but significant difference in level may unwontedly make appearance between the detection values upon changeover thereof in dependence on the engine operation mode, which will exert unfavorable influence to the throttle control.

On the other hand, employment of the A/D converter exhibiting a high resolution for detecting the throttle opening degree voltage with high accuracy incurs increasing in the cost of the apparatus as a whole.

SUMMARY OF THE INVENTION

In the light of the state of the art briefed above, it is an object of the present invention to provide a throttle control apparatus for an internal combustion engine which apparatus is capable of controlling the throttle opening degree on the basis of the throttle opening degree indicating voltage which is detected with high accuracy by employing an inexpensive A/D converter of a relatively low resolution without resorting to the method of changing over the detection values of the throttle opening degree.

In view of the above and other objects which will become apparent as the description proceeds, there is provided according to a general aspect of the present invention a throttle control apparatus for an internal combustion engine, which apparatus includes an electronic control type throttle for controlling operation of the internal combustion engine, a throttle opening degree detecting means for detecting an opening degree of the electronic control type throttle, and a control means for controlling the opening degree of the electronic control type throttle to a target value in dependence on operation state of the internal combustion engine. The throttle opening degree detecting means includes a throttle opening degree sensor for generating a sensor voltage corresponding to or indicative of the opening degree of the electronic control type throttle, an offset means for transforming the sensor voltage into a plurality of offset-weighted voltages, an A/D converter for performing A/D conversion (analogue-to-digital conversion) of the plurality of offset-weighted voltages, and an adder means for executing processing of adding the plurality of offset-weighted voltages resulting from the A/D conversion, wherein a sum value resulting from the addition of the plurality of offset-weighted voltages undergone the A/D conversion is detected as the opening degree of the electronic control type throttle destined to be controlled.

By virtue of the arrangement of the throttle control apparatus for the internal combustion engine, it is possible to control the throttle opening degree on the basis of the throttle opening degree indicating voltage detected with high accuracy by employing an inexpensive A/D converter of relatively low resolution without resorting to the method of changing over the detection values of the throttle opening degree known heretofore.

In a mode for carrying out the invention, the offset means mentioned above should preferably be composed of impedance elements with the throttle opening degree detecting means preferably including a buffer inserted between the throttle opening degree sensor and the impedance elements, wherein a circuitry including the throttle opening degree sensor and a circuitry including the impedance elements should preferably be isolated from each other by means of the buffer.

With the arrangement described above, impedance of the offset means can be lowered, whereby the throttle control apparatus ensuring further enhanced accuracy for the A/D conversion can be implemented.

In another mode for carrying out the invention, the adder means mentioned above should preferably include an averaging means for performing average processing of the plurality of offset-weighted voltages undergone the A/D conversion, wherein a sum value resulting from the addition of the plurality of offset-weighted voltages averaged by the averaging means is detected as the opening degree of the electronic control type throttle destined to be controlled.

Owing to the arrangement described above, erroneous detection attributable to various sorts of noise can be evaded, whereby the throttle control apparatus ensuring the control performance of further enhanced accuracy can be implemented.

In yet another mode for carrying out the invention, the offset means mentioned above should preferably be composed of a plurality of resistors having impedance values differing from one another, wherein the A/D converter should preferably be provided with a plurality of input terminals and designed to fetch simultaneously the plurality of offset-weighted voltages inputted from terminals of the plural resistors through the plurality of input terminals.

With the arrangement described above, the time taken for executing the A/D conversion of the offset-weighted voltages can be reduced.

In still another mode for carrying out the invention, the offset means mentioned above should preferably be composed of a plurality of resistors having impedance values differing from one another, and a plurality of switching means for selectively validating the plurality of resistors. In that case, the throttle opening degree detecting means should preferably include a switching control means for performing on/off-control of the plurality of switching means in accordance with a predetermined sequence. On the other hand, the A/D converter mentioned above should preferably be provided with a single input terminal and designed to fetch time-serially the plurality of offset-weighted voltages delivered in response to validations of the resistors, respectively, by way of the single input terminal.

With the arrangement described above, the number of the input terminals of the A/D converter as employed for generating the offset-weighted voltages can be decreased, whereby other available terminals of the A/D converter can be used for effectuating other control(s).

In a further mode for carrying out the invention, the A/D converter mentioned above should preferably be so designed as to perform twice the A/D conversion processing for the plurality of offset-weighted voltages so that a value resulting from the second A/D conversion is inputted to the adder means.

With the arrangement described above, erroneous detection attributable to crosstalk in the A/D converter can be avoided, whereby the control accuracy can further be enhanced.

In a yet further mode for carrying out the invention, the A/D converter mentioned above should preferably be so designed as to execute the A/D conversion processing for the plurality of offset-weighted voltages in an ascending order, starting from the voltage of a minimum value.

With the arrangement described above, erroneous detection attributable to the crosstalk which may take place internally of the A/D converter can be avoided, whereby the control accuracy can further be enhanced.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIG. 11 is a view showing on/off states of transistor switches for generating offset-weighted voltages according to the second embodiment of the invention.

DESCRIPTION OF THE PREFERRED EMBODIMENTS

Figure 1:
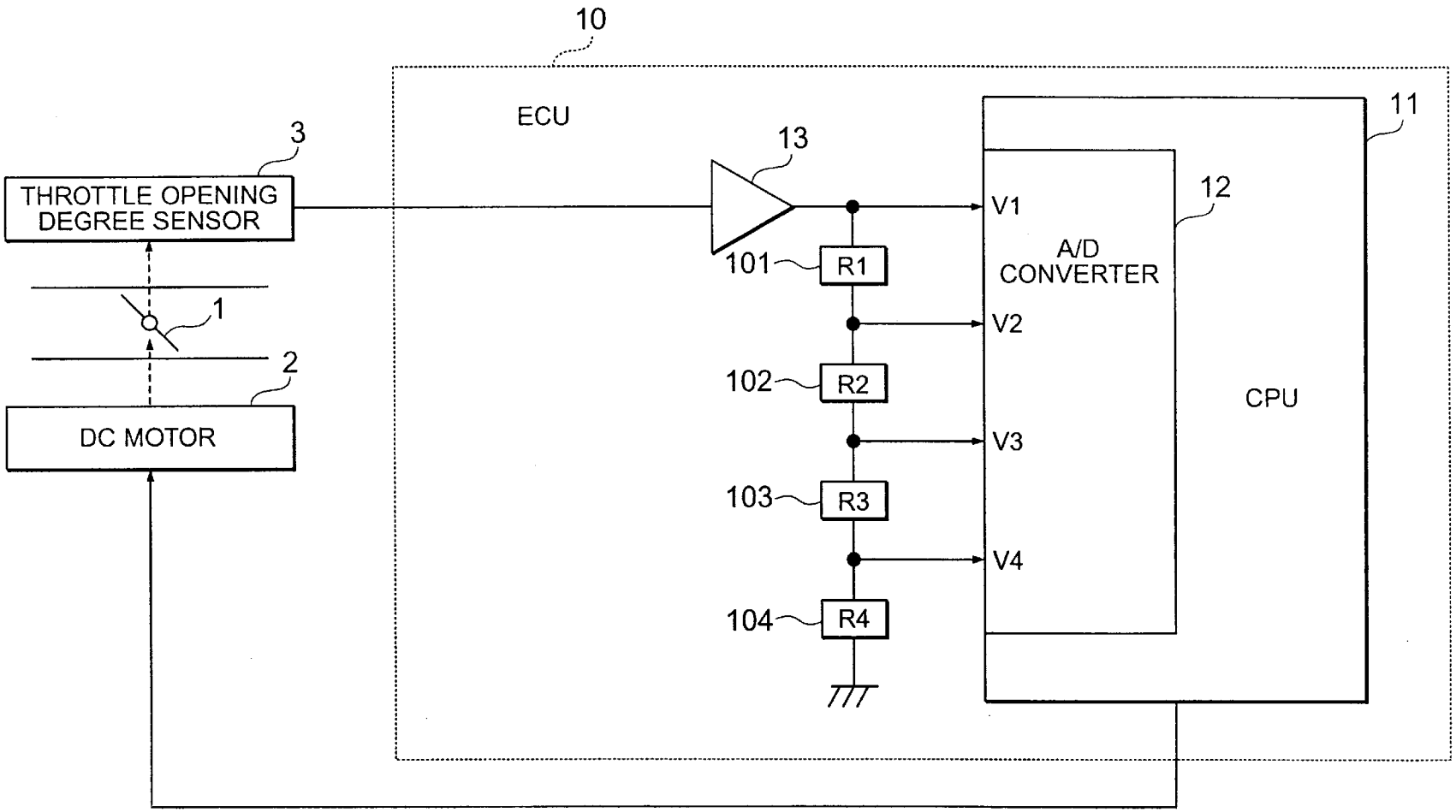
FIG. 1 is a block diagram showing an exemplary hardware configuration of a throttle control apparatus for an internal combustion engine according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

FIG. 1 is a block diagram showing an exemplary hardware configuration of a throttle control apparatus for an internal combustion engine according to a first embodiment of the present invention.

Referring to FIG. 1, an intake pipe of the internal combustion engine (also referred to simply as the engine) not shown is provided with a throttle valve 1 for regulating or adjusting the intake air flow (quantity of the intake air). A DC (direct current) motor 2 is provided in association with the throttle valve 1 as a throttle actuator for controlling the opening degree of the throttle valve. The throttle valve 1 and the DC motor 2 cooperate to constitute an electronic control type throttle for controlling the engine.

The throttle valve 1 is equipped with a throttle opening degree sensor 3 for generating a sensor voltage which indicates the opening degree of the throttle valve (also referred to as the throttle opening degree). The sensor voltage generated by the throttle opening degree sensor 3 is supplied to an ECU (Electronic Control Unit) 10 together with detection information (indicative of operation state of the engine) derived from other various types of sensors (not shown). On the basis of these input signals, the ECU generates a driving control signal for the DC motor 2.

The ECU 10 implemented in the form of a microprocessor or microcomputer is comprised of a CPU (Central Processing Unit) 11 which constitutes a major part of the microcomputer, an A/D (analogue to digital) converter 12 incorporated in the CPU 11, a plurality of resistors 101, . . . , 104 (offset means) inserted in an input circuitry of the A/D converter 12 and an operational amplifier (buffer) 13 which is inserted between an output terminal of the throttle opening degree sensor 3 and one input terminal of the A/D converter 12.

The resistors 101 to 104 have respective resistance or impedance values R1 to R4. These resistors 101 to 104 are inserted in a series connection between the output terminal of the operational amplifier 13 and the ground potential. With this arrangement, a plurality of offset-weighted voltages (i.e., voltages being offset relative to one another) V1 to V4 derived from the input voltage (sensor voltage outputted from the operational amplifier 13) make appearance at one ends of the resistors 101 to 104, respectively.

As is apparent from the above, the offset means mentioned above is implemented in the form of an impedance circuit including the resistors 101 to 104 for generating a plurality of offset-weighted voltages V1 to V4 inclusive of the input voltage V1, wherein one ends of the resistors 101 to 104 are connected to input terminals of the A/D converter 12, respectively.

The operational amplifier (buffer) 13 serves for separating the circuitry of the throttle opening degree sensor 3 and the impedance circuitry constituted by the resistors 101 to 104 (offset means) and thus contributes to lowering of the impedance or resistance values R1 to R4 of the resistors 101 to 104 and hence enhancement of the accuracy of the values resulting from the A/D conversion.

The A/D converter 12 serves for converting the offset-weighted voltages V1 to V4 inputted through the resistors 101 to 104, respectively, by way of the operational amplifier 13 into digital voltages, which are then inputted to an arithmetic processing unit incorporated in the CPU 11.

The resistors 101 to 104 have impedance values (resistance values) R1 to R4, respectively, which differ from one another. The A/D converter 12 is so designed as to fetch simultaneously through a plurality of input terminals the offset-weighted voltages V1 to V4 delivered from the one ends of the resistors 101 to 104, respectively, to thereby perform the A/D conversion processings for these offset-weighted voltages V1 to V4 in parallel.

The arithmetic processing unit incorporated in the CPU 11 includes an adder means (or summation means) for performing addition or summation processing for the plurality of offset-weighted voltages V1 to V4 each undergone the A/D conversion. Further, the adder means mentioned above includes an averaging means for performing average processing on the plurality of offset-weighted voltages V1 to V4, respectively, which have undergone the A/D conversion. Thus, the sum value of the plural offset-weighted voltages V1 to V4 undergone the A/D conversion and averaged by the averaging means is detected as the throttle opening degree (i.e., the opening degree of the throttle valve) which is destined to be controlled.

The throttle opening degree sensor 3, the operational amplifier 13, the resistors 101 to 104, the A/D converter 12 and the adder means (summation means) incorporated in the CPU 11 cooperate to constitute a throttle opening degree detecting means (i.e., means for detecting the opening degree of the throttle valve), wherein the sum value of the offset-weighted voltages V1 to V4 (the offset-weighted voltages undergone the A/D conversion and the average processing) is detected as the voltage signal indicative of the throttle opening degree of the electronic control type throttle which is the intrinsic object for the control now under consideration.

The arithmetic processing unit incorporated in the CPU 11 includes a throttle control means which is so designed or programmed as to arithmetically determine the desired or target value of the throttle opening degree in dependence on the operation state of the engine to thereby control the DC motor 2 so that the throttle opening degree is set in conformance to the target value.

By providing the offset means for converting the plurality of offset-weighted voltages V1 to V4 derived from the output voltage of the throttle opening degree sensor 3 and adding together or summing the offset-weighted voltages V1 to V4, as described above, it is possible to detect with enhanced accuracy the throttle opening degree destined to be controlled on the basis of the sum value resulting from the addition or summation mentioned above.

At this juncture, it should be mentioned that when the voltage signal derived from the output of the throttle opening degree sensor 3 is caused to pass through a low-pass filter composed of a resistor and a capacitor (not shown), the resistance values R1 to R4 of the resistors 101 to 104 have to be set to large values, respectively, in order to ensure the dynamic range for the sensor voltage indicative of the throttle opening degree.

In general, it is known that when external impedance increases upon conversion of the sensor voltage into the plural offset-weighted voltages V1 to V4, deviation will take place between the input voltage to the A/D converter 12 and the output voltage resulting from the A/D conversion.

With a view to evading the problem mentioned just above, the operational amplifier (buffer) 13 is inserted for effectuating the impedance conversion, as is shown in FIG. 1. By virtue of this arrangement, the resistance values R1 to R4 of the resistors 101 to 104 can be set to small values, respectively, which exert no unfavorable influence to the A/D conversion performed by the A/D converter 12.

Next referring to FIGS. 2 to 8, the processing operations performed by the A/D converter 12 and the adder means incorporated in the CPU 11 will be described in detail. At first, description will be directed to the resolution of the A/D converter 12.

In general, resolution a of the A/D converter 12 is represented by the number of bits. More specifically, the resolution of n bits (where n represents a natural number) is given by the following expression (1):

$$a=Vref/2^n \quad (1)$$

where Vref represents a reference voltage for the A/D converter 12.

The resolution a given by the above expression (1) means that the voltage of the value smaller than the value a can not discriminatively be identified.

Figure 2:
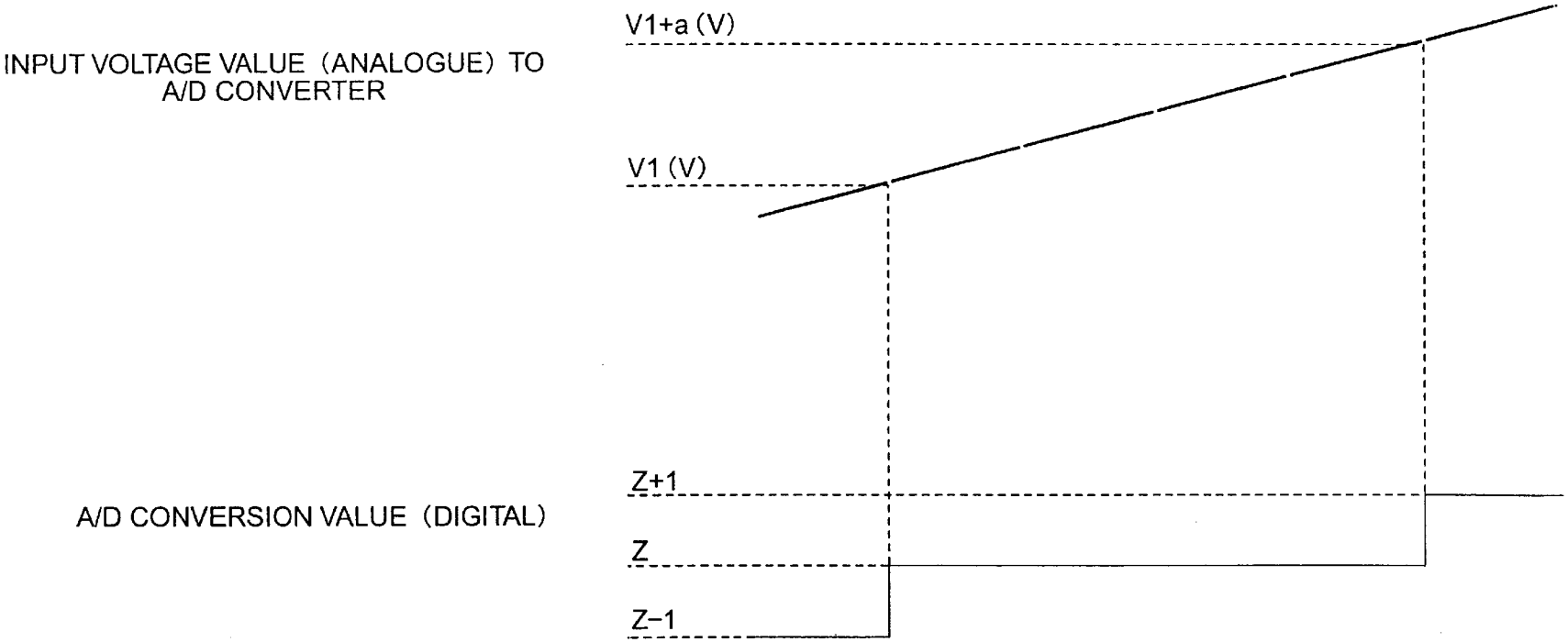
FIG. 2 is a view for graphically illustrating a relation between an analogue input voltage value of an A/D converter of n bits and digital values resulting from the A/D conversion according to the first embodiment of the invention.

FIG. 2 is a view for graphically illustrating a relation between the input voltage value (analogue value) V of the A/D converter 12 and the value (digital value) Z resulting from the A/D conversion. For the convenience of description, the latter will be referred to as the A/D conversion value. More specifically, FIG. 2 shows graphically the A/D conversion values Z−1, Z and Z+1 when the input voltage value of the A/D converter 12 rises up from V1 [V] to (V1+a) [V].

Referring to FIG. 2 and assuming that the A/D converter 12 of the resolution a[V] (n bits) given by the expression (1) is employed, and representing by V1 [V] the input voltage at which the A/D conversion value (i.e., digital value resulting from the A/D conversion) assumes Z, the input voltage at which the A/D conversion value assumes (Z+1) is given by (V1+a) [V].

To say in another way, so long as the input voltage V within the range given by (V1≦V<V1+a) undergoes the A/D conversion, the A/D conversion value obtained as the result of the A/D conversion is Z (constant value).

Figure 3:
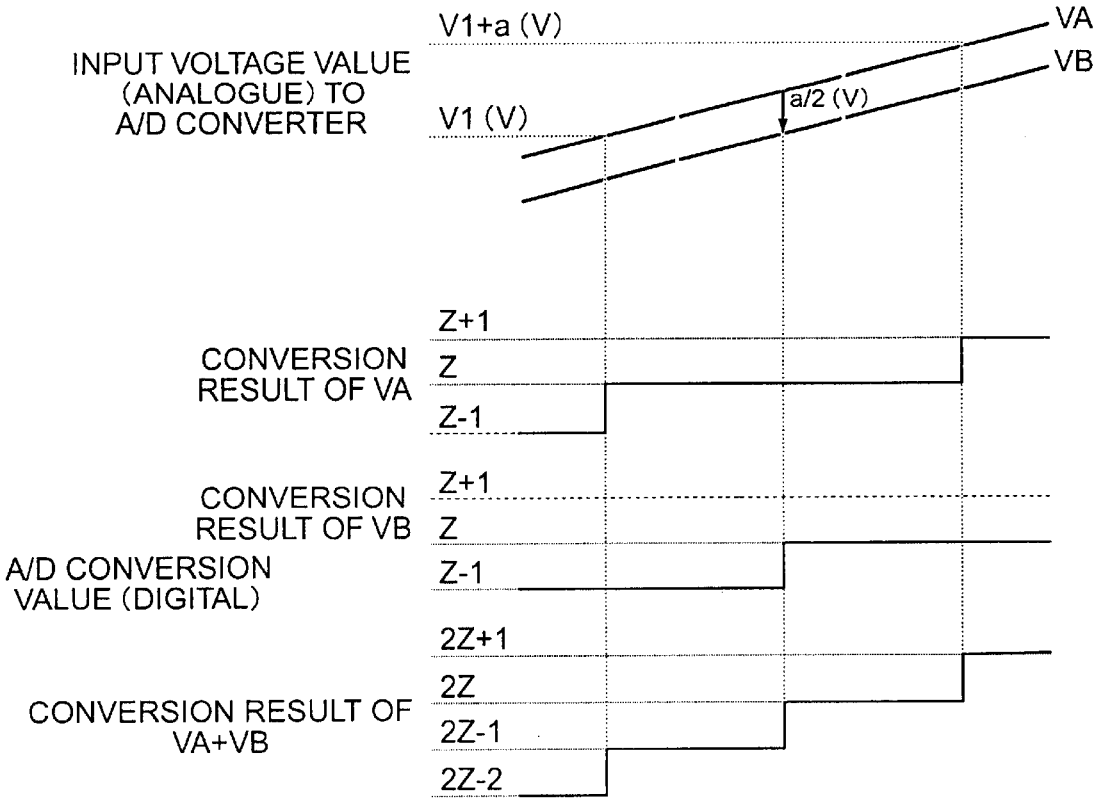
FIG. 3 is a view for graphically illustrating the principle underlying a high-accuracy sensor voltage detecting operation achieved by employing an adder means (summation means) according to the first embodiment of the invention.

FIG. 3 is a view for graphically illustrating enhancement of the throttle opening degree detecting accuracy through the input voltage detecting operation performed by the A/D converter 12 and the addition processing. This figure shows the processing operation which enables the input voltage detection equivalent to that realized by using the A/D converter having the resolution a/2 (n+1 bits) to be achieved by using the A/D converter 12 having the resolution a (n bits).

Referring to FIG. 3, an input voltage VA is subjected to the A/D conversion and at the same time an input voltage VB(=VA−a/2), i.e., the voltage offset by −a/2 [V] relative to the input voltage VA, is subjected to the A/D conversion, whereon the A/D conversion values of both the voltages VA and VB are added together. Thus, the A/D conversion value (result of VA+VB) of resolution a/2 (higher accuracy) can be obtained.

In other words, by deriving the offset-weighted voltage VB from the input voltage VA by means of the offset circuit, performing the A/D conversions of the voltage values VA and VB, respectively, with the resolution a of n bits and employing the sum value of the results of the A/D conversions for the throttle opening degree control, there can be realized a control resolution which is comparable or equivalent to that achieved with the A/D conversion value obtained by employing the A/D converter having resolution of a/2 (n+1 bits).

Thus, by applying the arithmetic operation processing mentioned above to the sensor voltage outputted from the throttle opening degree sensor 3 to thereby derive $2^b$ offset-weighted voltages which are offset by $-a/2^b$ [V] relative to one another (where b represents a natural number), inputting these offset-weighted voltages to the A/D converter 12 having resolution a[V] (n bits), and then adding together the A/D conversion values outputted from the A/D converter 12, the sensor voltage indicative of the throttle opening degree can be detected with high accuracy which is equivalent to that achieved when the A/D converter of (n+b) bits is employed.

In view of the above, by using the impedance circuit (offset means) incorporated in the ECU 10, voltages V1, V2, V3, V4 and so forth which are given, respectively, by V2=V1−$a/2^b$ [V], V3=V2−$a/2^b$ [V], V4=V3−$a/2^b$ [V] and so forth are derived from the input voltage V1 [V], to thereby make available the offset-weighted voltages V1, V2, V3, V4 and so forth.

In succession, the offset-weighted voltages V1, V2, V3, V4 and so forth are subjected to the A/D conversion by using the A/D converter 12 having n-bit resolution, whereon the digital values resulting from the A/D conversion are added together by the adder means incorporated in the CPU 11 to obtain the sum value which is then used for controlling the DC motor 2 and hence the throttle valve 1 by means of the throttle control means. In this manner, control resolution comparable to that achieved when the A/D converter of (n+b) bits is employed can be achieved.

By way of example, for controlling the idle speed (several hundreds rpm) of the engine with sufficiently high accuracy, it is known to perform the A/D conversion of the sensor voltage outputted from the throttle opening degree sensor 3 by employing the A/D converter having resolution higher than 12 bits inclusive.

In the case of the instant embodiment, four offset-weighted voltages V1 to V4 are generated by using four resistors 101 to 104 (which constitute the offset means). Accordingly, detection of the throttle opening degree in the vicinity of the idle speed (rpm) with accuracy on the order of essentially 12 bits by employing the A/D converter 12 of 10 bits will be described below.

Figure 4:
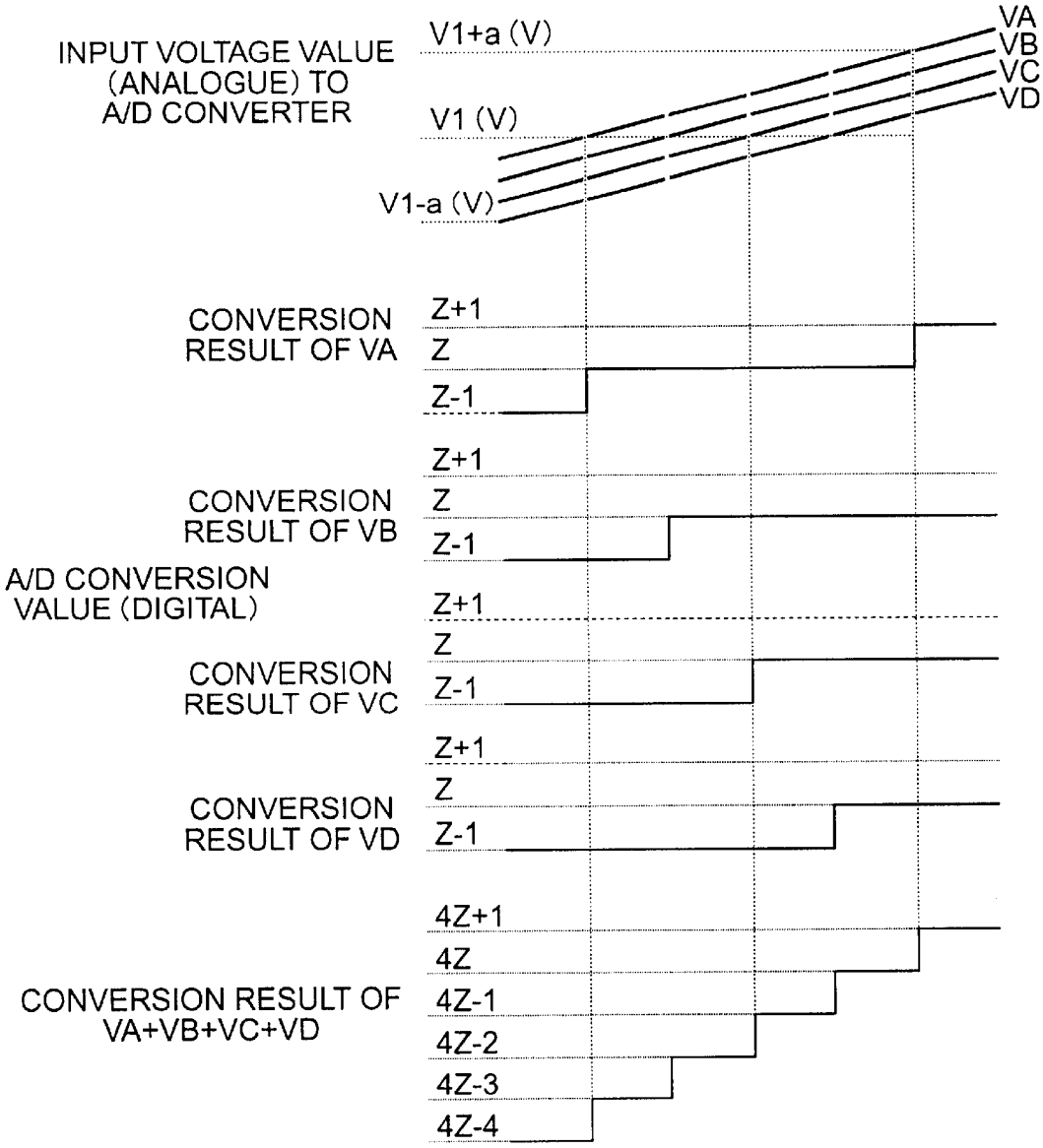
FIG. 4 is another view for graphically illustrating the principle underlying a high-accuracy sensor voltage detecting operation achieved by employing the adder means according to the first embodiment of the invention.

FIG. 4 is a view for graphically illustrating the processing operations performed by the A/D converter 12 of 10 bits and the adder means (summation means) on the assumption that four offset-weighted voltages VA to VD (corresponding to the offset-weighted voltages V1 to V4, respectively) are subjected to the A/D conversions, respectively, and then the results of the A/D conversions are added together to thereby realize the conversion accuracy of 12 (=10+2) bits.

Now assuming that the reference voltage Vref for the A/D converter 12 of 10 bits is 5 [V], resolution a of the A/D converter 12 can be given by the undermentioned expression (2) in view of the expression (1) mentioned hereinbefore. Namely, $$\begin{aligned} a &= 5/2^{10} \\ &\approx 4.8 \text{ [mV]} \end{aligned} \quad (2)$$

Accordingly, in order to realize the detection resolution of 12 bits, the natural number b mentioned previously is set to 2 (=12−10), and the offset VOF for each of the offset-weighted voltages V1 to V4 is determined in accordance with the following expression (3):

$$\begin{aligned} VOF &= a/2^2 \\ &= a/4 \\ &\approx 1.2 \text{ [mV]} \end{aligned} \quad (3)$$

Accordingly, the resistance values of the resistors 101 to 104 (see FIG. 1) are so selectively set that there can be generated on the basis of the input voltage VA (=V1) supplied from the throttle opening degree sensor 3, the offset-weighted voltage VB(=V2), VC (=V3) and VD (=V4) which are represented by VB≈VA−1.2 [mV], VC≈VB−1.2 [mV] and VD≈VC−1.2 [mV], respectively.

The offset-weighted voltages VA, VB, VC and VD (=V1, V2, V3 and V4) then undergo the A/D conversions, respectively, through the A/D converter 12 of 10 bits, whereon the results of the A/D conversions are added together by the adder means to thereby detect the concerned throttle opening degree (represented by the sum of VA+VB+VC+VD) with the resolution increased by two bits.

In this conjunction, it is however noted that since the offset circuit shown in FIG. 1 is so arranged as to generate the offset-weighted voltages V2 to V4 by dividing the input voltage V1 by the resistors 101 to 104, the offset-weighted voltage, e.g. V2, will vary when the input voltage V1 changes. Consequently, the offset-weighted voltage V2 does not always coincide accurately with the voltage value of V1−1.2 [mV] mentioned previously.

However, so far as the high-accuracy control of the throttle valve 1 only in the idle operation mode is concerned, the resistance values R1 to R4 of the resistors 101 to 104 may be set so that the offset-weighted voltage V2, V3 and V4 can be represented by the undermentioned expressions (4) approximately at the sensor voltage of the throttle opening degree sensor 3 in the idle operation mode. Namely, $$V2 \approx V1 - 1.2\ [\mathrm{mV}]$$

$$V3 \approx V2 - 1.2\ [\mathrm{mV}]$$

$$V4 \approx V3 - 1.2\ [\mathrm{mV}] \qquad (4)$$

By way of example, when the sensor voltage detected in the idle operation mode is approximately of 0.7 [V], the resistance values R1 to R4 may be selected as given by the following expressions (5):

$$R1 = R2 = R3 = 18\ [\Omega]$$

$$R4 = 10\ [k\Omega] \qquad (5)$$

Next, referring to a timing chart shown in FIG. 5 and a flow chart shown in FIG. 6, description will be made in concrete of the interrupt processing (A/D conversion processing) for the four offset-weighted voltages V1 to V4 inputted to the A/D converter 12.

Figure 5:
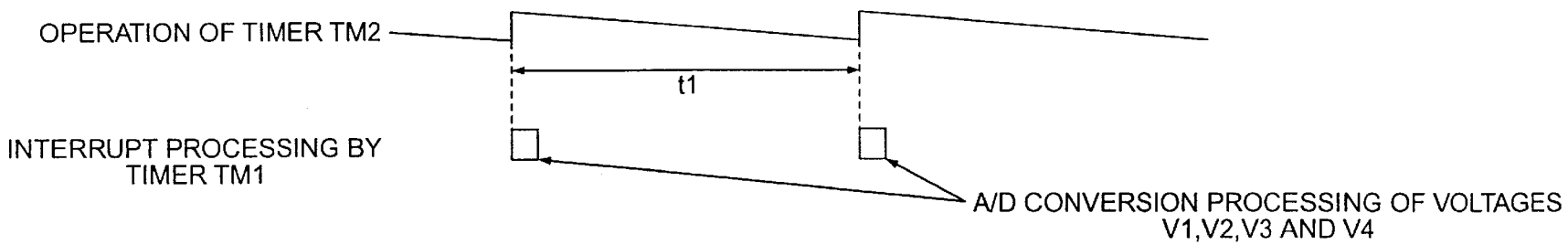
FIG. 5 is a timing chart showing an A/D conversion operation (timer interrupt operation) according to the first embodiment of the invention.

The A/D conversion processing illustrated in FIG. 5 is periodically executed in response to an interrupt request issued by a timer TM1. In this conjunction, it should be mentioned that the interrupt processing with the timer TM1 itself is known in the art, as disclosed in, for example, Japanese Patent No. 3093467.

The time period t1 set at the timer TM1 (i.e., periodical interval at which the A/D conversion processing routine is executed) is validated in the course of execution of a series of initialize processings executed when the CPU 11 is activated in response to closing (turn-on) of an ignition key of a motor vehicle equipped with the engine now under consideration.

Figure 6:
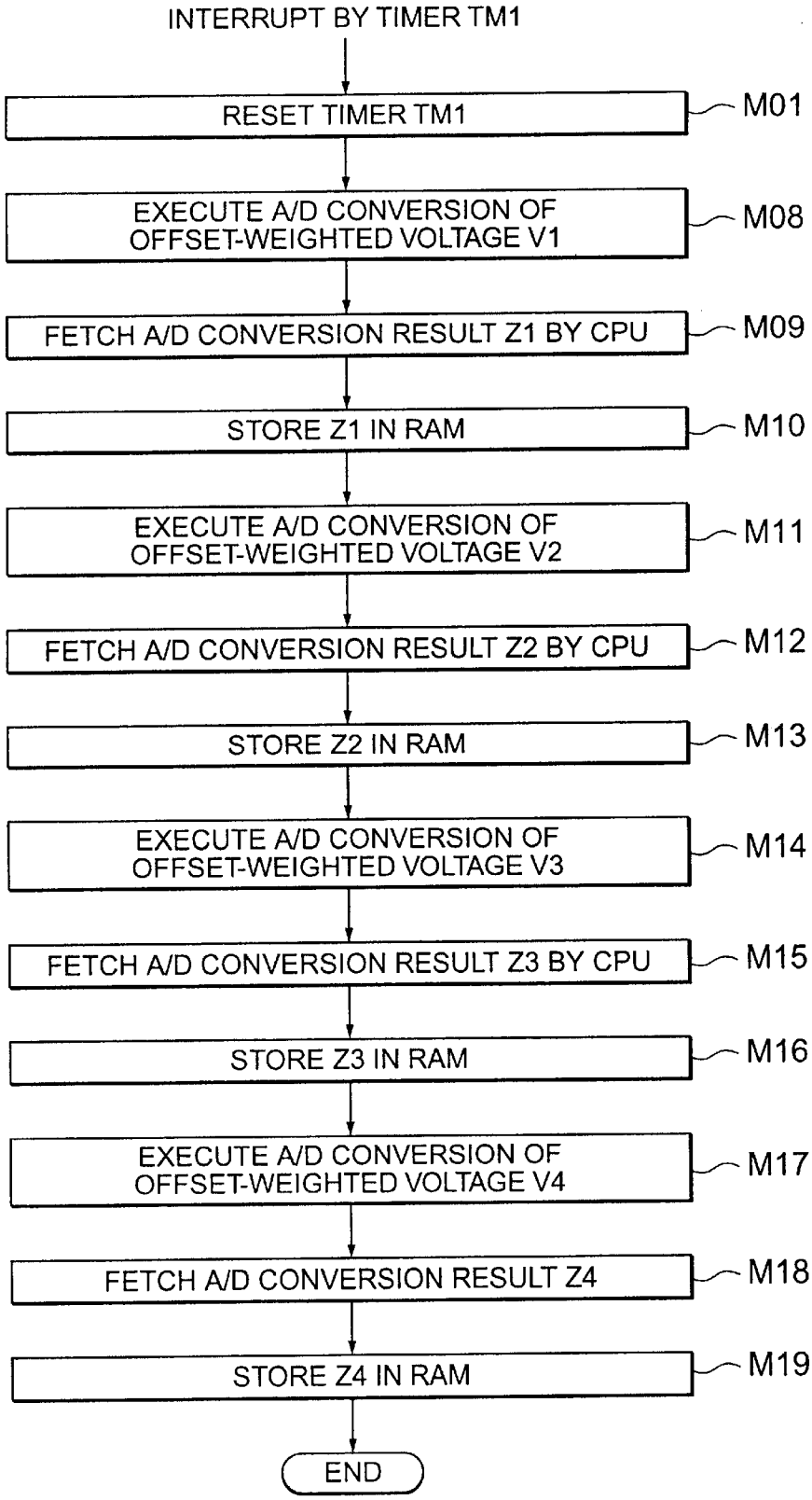
FIG. 6 is a flow chart for illustrating in concrete an A/D conversion processing according to the first embodiment of the invention.

FIG. 6 shows in concrete the interrupt processing procedure triggered by the timer TM1.

Referring to FIG. 6, the timer TM1 is first reset (step M01) and the input voltage V1 undergoes the A/D conversion by the A/D converter 12 (step M08).

At the end of the A/D conversion of the input voltage V1 (step M08), the CPU 11 fetches the result of the A/D conversion (hereinafter also referred to as the A/D conversion result only for the convenience of description) designated by Z1 in a step M09 to store the A/D conversion result Z1 in a RAM (Random Access Memory) in a step M10.

In succession, the offset-weighted voltage V2 is subjected to the A/D conversion processing (step M11). At the end of this A/D conversion, the CPU 11 fetches the A/D conversion result Z2 (step M12) for storage in the RAM (step M13).

Subsequently, the processing procedure similar to the steps M08 to M13 described above is executed for each of the offset-weighted voltages V3 and V4 in the steps M14 to M19, the conversion results Z3 and Z4 being stored in the RAM.

At this juncture, it is to be added that the voltage V1 which first undergoes the A/D conversion upon execution of the A/D conversion processing shown in FIG. 6 may unwantedly be affected by the influence of the A/D conversion processing executed just before due to crosstalk phenomenon in the A/D converter 12.

Under the circumstances, it is preferred to execute the A/D conversion processing twice for the input voltage V1 and input the second A/D conversion value (i.e., value obtained after "twice-read" processing) to the adder means virtually as the value undergone a delay processing.

Of course, the twice-read processing mentioned above may be executed upon execution of the A/D conversion for each of the offset-weighted voltages V2 to V4 inputted in succession to the voltage V1 for the purpose of evading the influence of the crosstalk in the A/D converter.

Furthermore, with a view to minimizing the influence of the crosstalk in the A/D converter 12, the processing sequence for the A/D conversion may appropriately be altered or modified without being fixed. By way of example, the A/D conversion may be executed, starting from the voltage V4 which is of the smallest value among the voltages V1 to V4, in the order of the voltages V4, V3, V2 and finally V1. Thus, the influence of the crosstalk can be suppressed to a minimum, whereby the detection accuracy can further be enhanced.

Next referring to a timing chart shown in FIG. 7 and a flow chart shown in FIG. 8, description will be made of the operation for detecting the throttle opening degree finally recognized by the arithmetic processing unit incorporated in the CPU 11.

Figure 7:
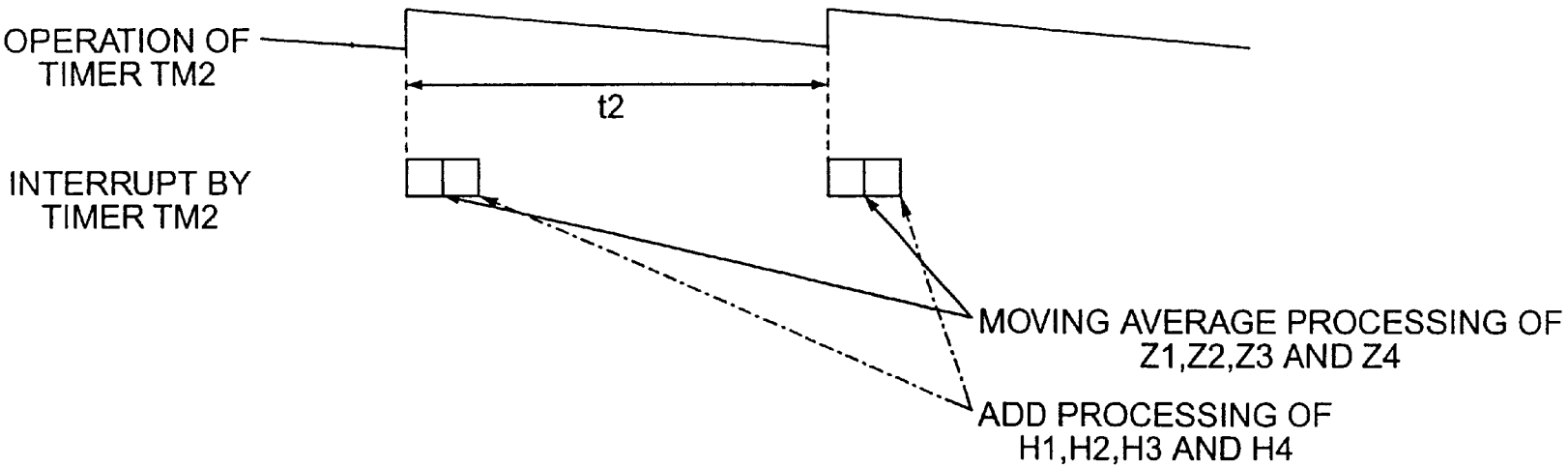
FIG. 7 is a timing chart showing a move average processing operation and an addition or summation processing operation executed by a CPU (arithmetic processing unit) according to the first embodiment of the invention.

Referring to FIG. 7, the CPU 11 starts to periodically execute the arithmetic operation processing in response to the interrupt request issued by a timer TM2.

The time period t2 (updated arithmetic operation period for the throttle opening degree recognized by the CPU 11) set at the timer TM2 is validated in the course of a series of initialize processings executed by the CPU 11 upon activation thereof in response to the turn-on (closing) of the ignition key of the motor vehicle.

The voltages V1 to V4 undergo the A/D conversion every period t1 through the interrupt processing procedure triggered by the timer TM1, the A/D conversion results Z1 to Z4 being stored in the RAM, as described hereinbefore. Thus, there are stored in the RAM of the CPU 11 the latest results Z1 to Z4 resulting from the A/D conversions performed every period t1.

In that case, when the A/D conversion results over several periods are required in the arithmetic operation processing for determining the throttle opening degree by the CPU 11, it is necessary to secure in the RAM a location capable of storing the A/D conversion results over several successive periods.

Figure 8:
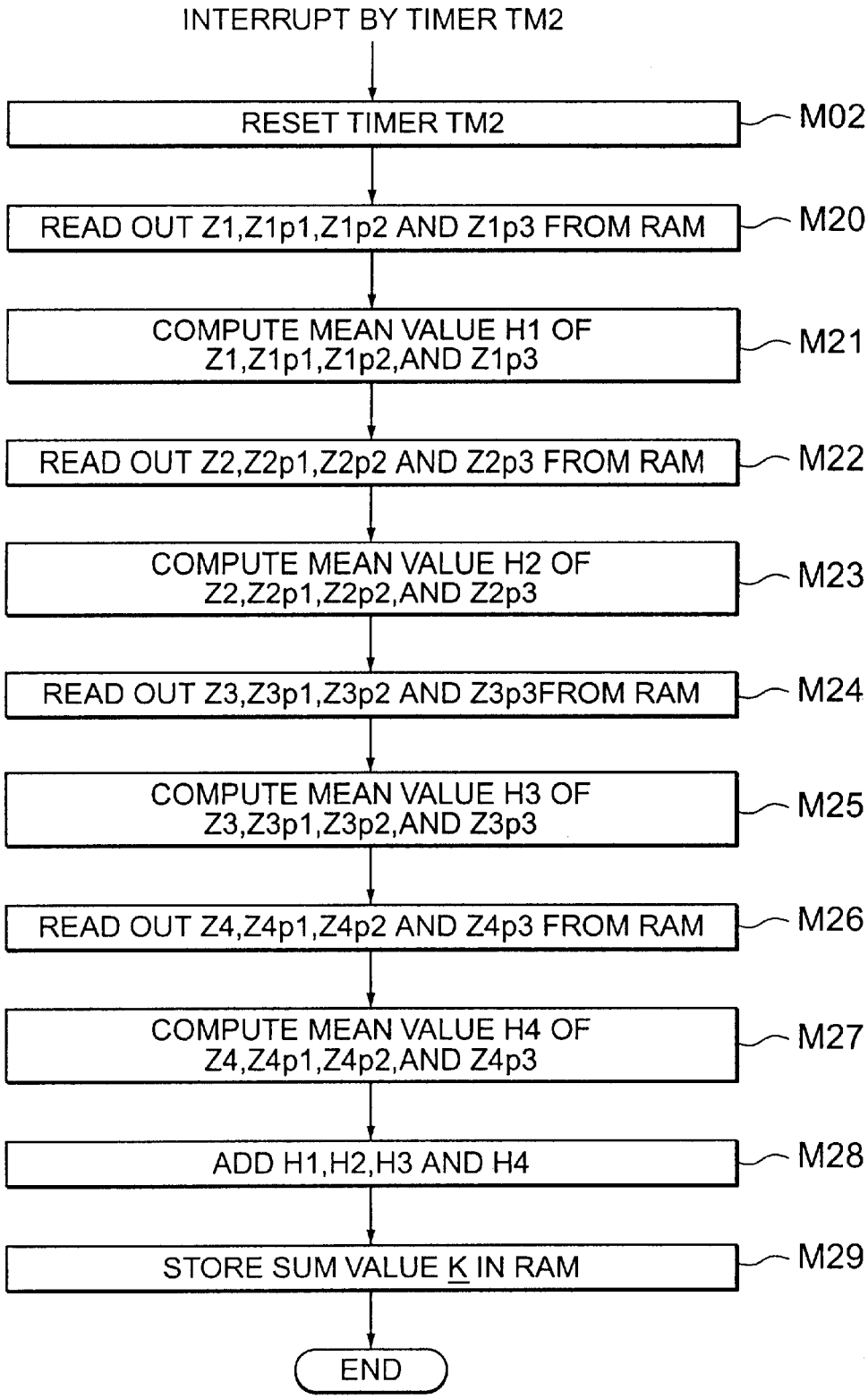
FIG. 8 is a flow chart for illustrating in concrete the move average processing operation and the addition or summation processing operation executed by the CPU (arithmetic processing unit) according to the first embodiment of the invention.

FIG. 8 is a flow chart for illustrating in concrete the processing sequence for adding the A/D conversion results Z1 to Z4 of the voltages V1 to V4 after carrying out a moving average method.

For determining the move averages for four A/D conversion results Z1 to Z4, an averaging means incorporated in the CPU 11 is designed to perform the average processing on not only the latest A/D conversion result Z1 but also the immediately preceding A/D conversion result Z1*p*1, the by-one preceding A/D conversion result Z1*p*2 and the by-two preceding A/D conversion result Z1*p*3 stored in the RAM for e.g. the input voltage V1.

To this end, the averaging means first resets the timer TM2 in a step M02 shown in FIG. 8 and reads out the A/D conversion results Z1, Z1*p*1, Z1*p*2 and Z1*p*3 from the RAM in a step M20 to thereby arithmetically determine a mean value H1 thereof in a step M21.

Through the moving average processing described above, detection error attributable to peak noise and others can effectively be suppressed. Incidentally, the moving average method itself is known in the art. Accordingly, any further description thereof will be unnecessary.

In succession, in steps M22 to M27, the processings similar to those in the steps M20 and M21 described above are executed for the voltages V2, V3 and V4 to thereby determine arithmetically the mean values H2, H3 and H4, respectively. Subsequently, the processing of adding together the mean values H1 to H4 is executed (step M28), and thus the sum value K (=H1+H2+H3+H4) is stored in the RAM (step M29).

In this manner, the offset-weighted voltages V1 to V4 first undergo the A/D conversion through the 10-bit A/D converter 12 (having the resolution a), whereon the sum value K of the mean values H1 to H4 of the values resulting from the A/D conversion is finally determined as the detection value of the throttle opening degree destined to be controlled.

By virtue of the processing procedure described above, the control accuracy comparable to that realized by using the 12-bit A/D converter can be achieved by using the 10-bit A/D converter 12, whereby the throttle opening degree indicating voltage can be detected with high accuracy even in the idle operation mode.

Thus, it is possible according to the teachings of the present invention incarnated in the instant embodiment thereof to detect the throttle opening degree with high accuracy for controlling the throttle opening degree with correspondingly enhanced accuracy by using the A/D converter 12 of low resolution without need for changing over the detection value of the throttle opening degree sensor 3.

The CPU 11 recognizes the sum value as the sensor voltage indicating the throttle opening degree and performs a feedback control for making the throttle opening degree coincide with the desired or target opening degree.

Incidentally, since the arithmetic determination of the target throttle opening degree and the feedback control of the throttle opening degree are known in the art and because they do not constitute essentially any major part of the present invention, further description in detail thereof will be unnecessary.

In the case of the throttle control apparatus for the internal combustion engine described above, four resistors 101 to 104 are employed for generating the four offset-weighted voltages V1 to V4. It should however be appreciated that the present invention is never restricted to any specific number of the resistors and the offset-weighted voltages but an arbitrary number of the resistors (e.g. eight resistors) may be used to generate a corresponding number of the offset-weighted voltages (e.g. eight offset-weighted voltages) although not illustrated.

At this juncture, it should further be mentioned that the important feature of the present invention can be seen in the arrangement that the adder means for enhancing effectively the resolution is provided for adding together the A/D conversion values of the offset-weighted voltages V1 to V4. Accordingly, other means than the adder means such as exemplified by the operational amplifier (buffer) 13 and the averaging means incorporated in the CPU 11 for further enhancing the control accuracy may be spared without departing from the spirit and scope of the present invention.

Similarly, in conjunction with the A/D converter 12, the twice read processing for suppressing the adverse influence of the crosstalk and the means for setting the A/D conversion order for the offset-weighted voltages V1 to V4 may equally be spared within the purview of the present invention.

Furthermore, although the foregoing description has been made on the assumption that the throttle control apparatus for the internal combustion engine according to the present invention is applied to the internal combustion engine of a motor vehicle, it goes without saying that the present invention can find application to other types of engines so far as they are provided with the electronic control type throttle.

Embodiment 2

In the case of the throttle control apparatus according to the first embodiment of the present invention, the offset-weighted voltages V1 to V4 are simultaneously inputted to the A/D converter 12 to undergo the A/D conversion processings in parallel with a view to reducing the time taken for the A/D conversion. However, in order to make it possible to use the A/D converter having a single input terminal, such arrangement can equally be adopted in which that the offset-weighted voltages V1 to V4 are time-serially inputted to the A/D converter.

In the following, referring to FIGS. 9 to 11, description will be made of the throttle control apparatus according to a second embodiment of the present invention which is arranged such that the offset-weighted voltages V1 to V4 are time-serially inputted to the A/D converter.

Figure 9:
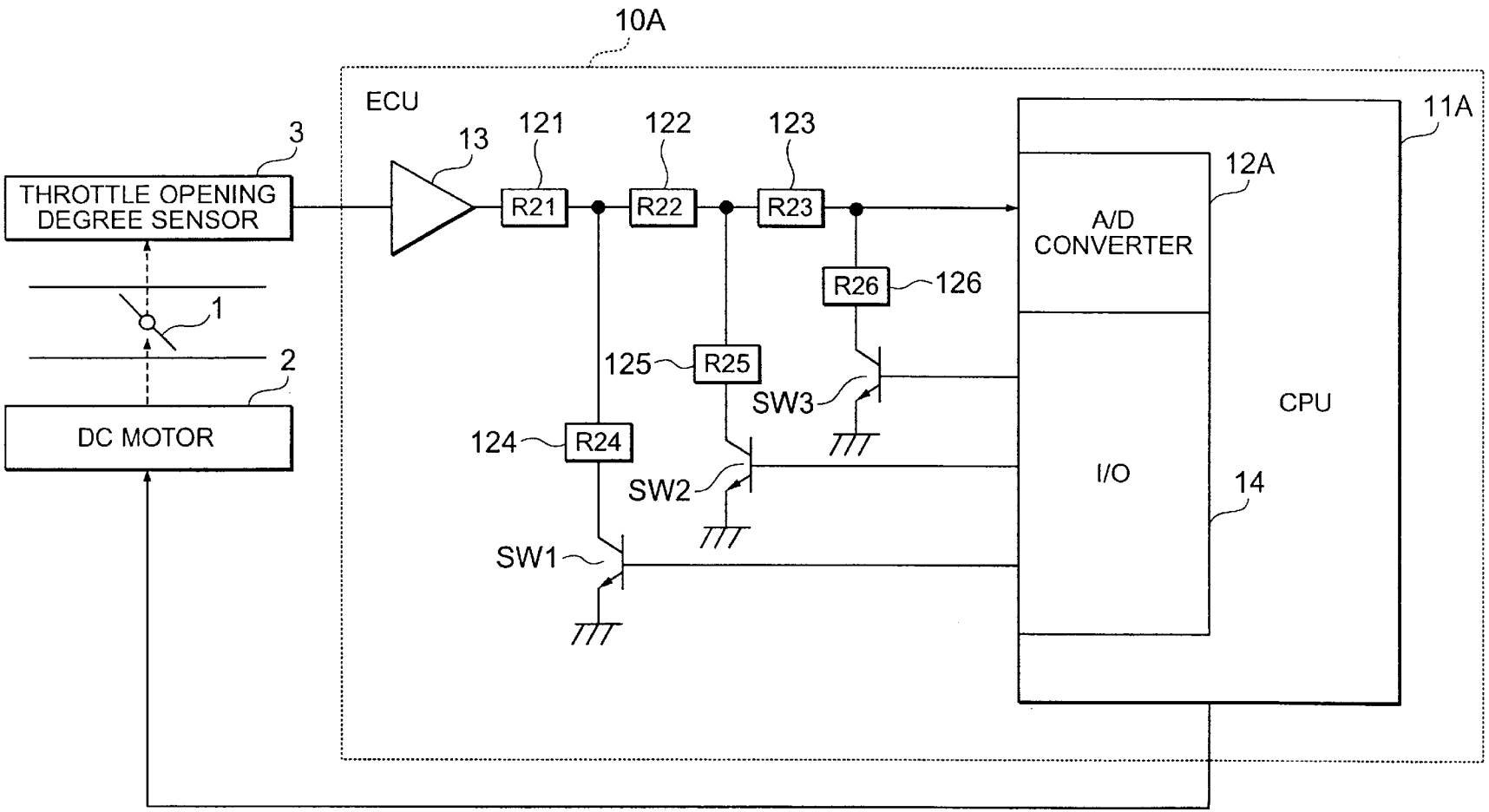
FIG. 9 is a block diagram showing generally an exemplary hardware configuration of a throttle control apparatus for the internal combustion engine according to a second embodiment of the present invention.

FIG. 9 is a block diagram sowing an exemplary hardware configuration of the throttle control apparatus according to the second embodiment of the present invention, in which components similar or equivalent to those described hereinbefore by reference to FIG. 1 are denoted by like reference numerals with "A" being attached as the case may be.

As can be seen in FIG. 9, an ECU 10A of the throttle control apparatus according to the instant embodiment of the invention includes resistors 121 to 126, transistor switches (hereinafter also referred to simply as the switch) SW1 to SW3 and an I/O (Input/Output) interface 14 in addition to the CPU 11A, the A/D converter 12A and the operational amplifier 13 described hereinbefore in conjunction with the first embodiment of the invention.

In the throttle control apparatus now under consideration, the A/D converter 12A is provided with only one input terminal for use. The I/O interface 14 serves as a switching control means for on/off control of the switches SW1 to SW3 in accordance with a predetermined sequence.

The resistors 121 to 126 cooperate with the switches SW1 to SW3 and the I/O interface 14 to constitute an offset means for generating the offset-weighted voltages V1 to V4.

The resistors 121 to 126 have respective impedances (resistance values R21 to R26) which differ from one to another. The switches SW1 to SW3 serve to selectively validate the resistors 121 to 126.

The resistors 121 to 123 are inserted in series between the output terminal of the operational amplifier (buffer) 13 and the input terminal of the A/D converter 12A while the other resistors 124 to 126 are individually connected to one ends of the resistors 121 to 123, respectively.

The I/O interface 14 selectively controls the ON/OFF states of the individual switches SW1 to SW3 so that the offset-weighted voltages V1 to V4 can time-serially be delivered from the one end of the resistor 123.

The A/D converter 12A fetches the offset-weighted voltages V1 to V4 generated in response to the ON-operations of the switches SW1 to SW3 (validations of the resistors 123 to 126) through the single input terminal.

In this conjunction, the resistance values R21 to R26 of the resistors 121 to 126, respectively, may be set, for example, as follows:

$$R21=R22=R23=18\ [\Omega]$$

$$R24=R25=R26=10\ [k\Omega] \quad (6)$$

Thus, when all of the switches SW1 to SW3 are turned off, the component resistance values of the serially-connected resistors 121 to 123 are all validated, as a result of which the offset-weighted voltage V1 having a maximum level or value is generated to be inputted to the A/D converter 12A.

On the other hand, in the case where only the switch SW1 is turned on, one end of the resistor 121 connected closest to the output of the operational amplifier 13 among the serially connected resistors 121 to 123 is branched to the ground potential, whereby the voltage V2 having a second high level is generated to be inputted to the A/D converter 12A.

Further, when only the switch SW2 is turned on, one end of the second resistor 122 among the serially connected resistors 121 to 123 is branched to the ground potential, whereby the voltage V3 having a third high level is generated to be inputted to the A/D converter 12A.

Furthermore, when only the switch SW3 is turned on, one end of the resistor 123 connected most remotely from the output terminal of the operational amplifier 13 among the serially connected resistors 121 to 123 is branched to the ground potential, whereby the voltage V4 having a minimum level or value is generated to be inputted to the A/D converter 12A.

In this manner, by sequentially controlling the switches SW1 to SW3 by the I/O interface 14, the offset-weighted voltages V1 to V4 similar to those described hereinbefore can time-serially be generated to undergo the A/D conversion.

Next referring to a flow chart shown in FIG. 10 together with FIG. 11 which illustrates the on/off sequences, interrupt processing procedure (A/D conversion processing) executed by the A/D converter 12A will be described in detail. In FIG. 11, the on/off states of the switches SW1 to SW3 corresponding to the individual input voltages V1 to V4 are shown.

Figure 10:
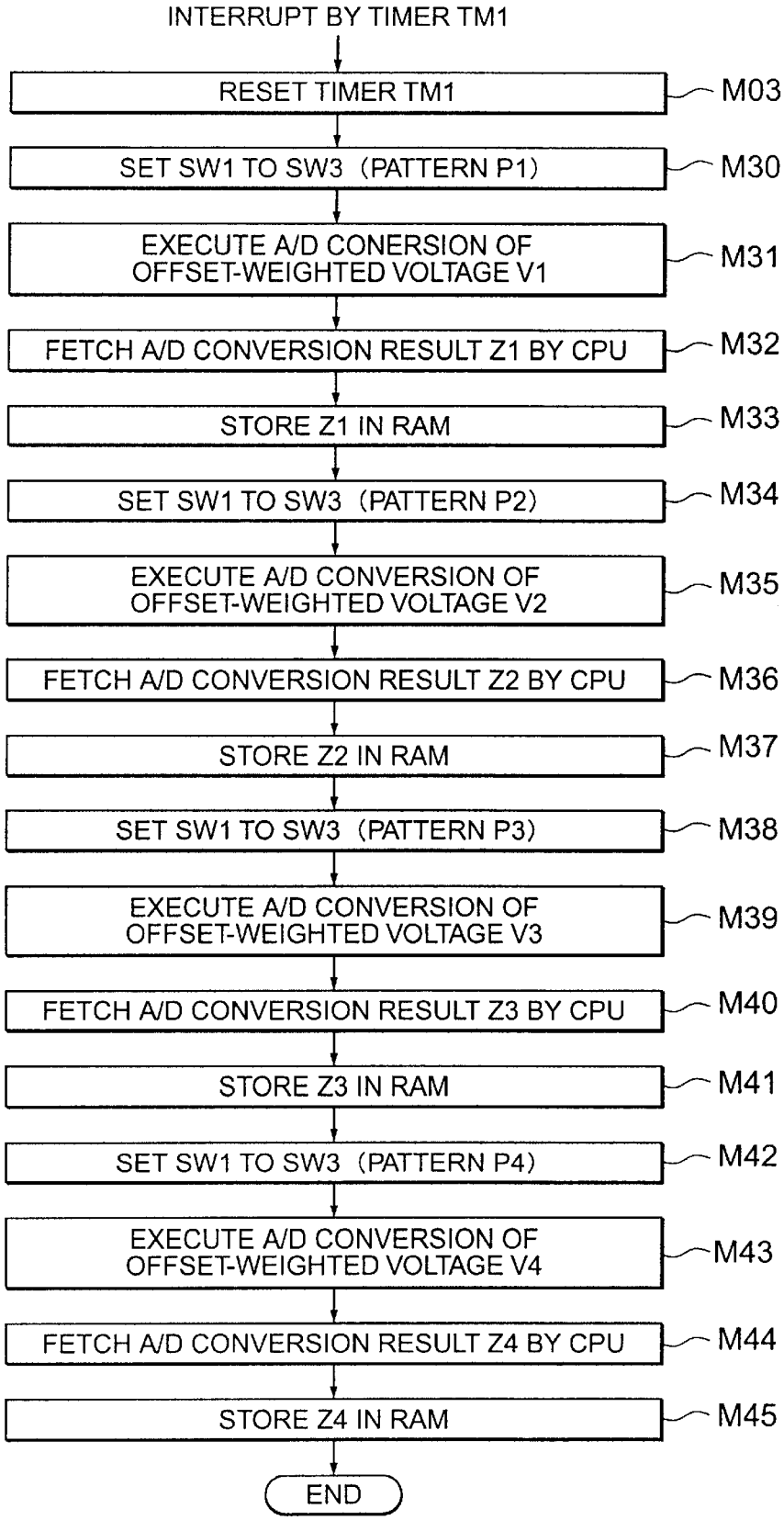
FIG. 10 is a flow chart for illustrating in concrete an A/D conversion processing operation according to the second embodiment of the invention.

Referring to FIG. 10, the A/D converter 12A first resets the timer TM1 in response to the interrupt processing procedure of the timer TM1 (step M03).

In succession, all the switches SW1 to SW3 are turned off in conformance with a pattern P1 shown in FIG. 11 so that the voltage V1 of the maximum value is generated by the offset means (step M30).

Subsequently, the voltage V1 undergoes the A/D conversion by the A/D converter 12A (step M31). After the A/D conversion, the CPU 11A fetches the conversion result (i.e., result of the A/D conversion) Z1 (step M32) for storage in the RAM (step M33).

Subsequently, the A/D converter 12A and the CPU 11A execute the A/D conversion processing for the offset-weighted voltages V2 to V4, respectively, in steps M34 to M45 similarly to the steps M30 to M33 mentioned above. Thus, the conversion results Z2 to Z4 are stored in the RAM.

Subsequently, the average processing and the summation or addition processing are executed for the A/D conversion results Z1 to Z4. Since these processings are similar to those described hereinbefore by reference to FIG. 8, repeated description is omitted. It goes, however, without saying that the advantageous or profitable effects mentioned previously can equally be obtained.

Further, in the throttle control apparatus for the internal combustion engine according to the second embodiment of the invention, only one of the input terminal of the A/D converter 12A is employed for the A/D conversion of the offset-added voltages. Thus, the other input terminals may be allotted to other controls.

Many modifications and variations of the present invention are possible in the light of the above techniques. It is therefore to be understood that within the scope of the appended claims, the invention may be practiced otherwise than as specifically described.

What is claimed is:

1. A throttle control apparatus for an internal combustion engine, comprising:

an electronic control type throttle for controlling operation of an internal combustion engine;

throttle opening degree detecting means for detecting an opening degree of said electronic control type throttle; and control means for controlling said opening degree of said electronic control type throttle to a target value in dependence on operation state of said internal combustion engine, wherein said throttle opening degree detecting means comprising:

a throttle opening degree sensor for generating a sensor voltage corresponding to said opening degree of said electronic control type throttle;

offset means for transforming said sensor voltage into a plurality of offset-weighted voltages;

an A/D converter for performing A/D conversion (analogue-to-digital conversion) of said plurality of offset-weighted voltages; and adder means for executing processing of adding said plurality of offset-weighted voltages resulting from said A/D conversion, wherein a sum value resulting from the addition of said plurality of offset-weighted voltages undergone said A/D conversion is detected as the opening degree of said electronic control type throttle destined to be controlled.

2. A throttle control apparatus for an internal combustion engine according to claim 1, said offset means including impedance elements;

said throttle opening degree detecting means including a buffer inserted between said throttle opening degree sensor and said impedance elements;

wherein a circuitry including said throttle opening degree sensor and a circuitry including said impedance elements are isolated from each other by means of said buffer.

3. A throttle control apparatus for an internal combustion engine according to claim 1, said adder means including averaging means for performing average processing of said plurality of offset-weighted voltages undergone said A/D conversion, wherein a sum value resulting from the addition of said plurality of offset-weighted voltages averaged by said averaging means is detected as the opening degree of said electronic control type throttle destined to be controlled.

4. A throttle control apparatus for an internal combustion engine according to claim 1, said offset means including a plurality of resistors having impedance values differing from one another, wherein said A/D converter is provided with a plurality of input terminals and designed to fetch simultaneously said plurality of offset-weighted voltages inputted from terminals of said plural resistors through said plurality of input terminals.

5. A throttle control apparatus for an internal combustion engine according to claim 1, said offset means including:

a plurality of resistors having impedance values differing from one another; and a plurality of switching means for selectively validating said plurality of resistors, said throttle opening degree detecting means including switching control means for performing on/off-control of said plurality of switching means in conformance with a predetermined sequence, wherein said A/D converter is provided with a single input terminal and designed to fetch time-serially said plurality of offset-weighted voltages delivered in response to validations of said resistors, respectively, through said single input terminal.

6. A throttle control apparatus for an internal combustion engine according to claim 1, said A/D converter being so designed as to perform twice the A/D conversion processing for said plurality of offset-weighted voltages, wherein a value resulting from the second A/D conversion is inputted to said adder means.

7. A throttle control apparatus for an internal combustion engine according to claim 1, wherein said A/D converter is so designed as to execute the A/D conversion processing for said plurality of offset-weighted voltages in an ascending order, starting from the voltage of a minimum value.

* * * * *